US007240629B2

(12) United States Patent
Patterson

(10) Patent No.: US 7,240,629 B2
(45) Date of Patent: Jul. 10, 2007

(54) METHOD AND APPARATUS FOR MINIMIZING SEW SELVEDGE

(75) Inventor: Catherine M. Patterson, Sylvan Lake, MI (US)

(73) Assignee: Eagle Ottawa, LLC, Rochester Hills, MI (US)

( * ) Notice: Subject to any disclaimer, the term of this patent is extended or adjusted under 35 U.S.C. 154(b) by 0 days.

(21) Appl. No.: 11/293,759

(22) Filed: Dec. 2, 2005

(65) Prior Publication Data

US 2006/0118016 A1 Jun. 8, 2006

Related U.S. Application Data

(60) Provisional application No. 60/633,716, filed on Dec. 6, 2004.

(51) Int. Cl.
*D05B 5/10* (2006.01)
*D05B 1/00* (2006.01)

(52) U.S. Cl. ..... 112/475.06; 112/153; 112/240

(58) Field of Classification Search ..... 112/153, 112/306, 136, 235, 151, 2.1, 260, 240, 475.06, 112/470.07, 141, 152, 139
See application file for complete search history.

(56) References Cited

U.S. PATENT DOCUMENTS

| | | | | |
|---|---|---|---|---|
| 288,529 | A | 11/1883 | Wellman | |
| 389,152 | A | 9/1888 | Hunter | |
| 968,346 | A * | 8/1910 | Hamlin | 112/153 |
| 1,103,836 | A * | 7/1914 | Raplee | 112/151 |
| 1,421,131 | A * | 6/1922 | Abrams | 2/92 |
| 2,398,475 | A | 4/1946 | Stritter | |
| 2,478,032 | A * | 8/1949 | Wallsh | 112/151 |
| 2,915,027 | A * | 12/1959 | Smith | 112/2.1 |
| 3,031,985 | A * | 5/1962 | Kalning et al. | 112/2.1 |
| 3,146,743 | A * | 9/1964 | Minehan | 112/151 |
| 3,155,060 | A | 11/1964 | Brenner | |
| 3,489,114 | A * | 1/1970 | Seck | 112/240 |
| 3,616,771 | A * | 11/1971 | Gray et al. | 112/306 |
| 4,467,739 | A * | 8/1984 | Hager et al. | 112/153 |
| 4,676,179 | A | 6/1987 | Nomura et al. | |
| 4,991,526 | A | 2/1991 | Jean Blanc | |
| 5,054,407 | A | 10/1991 | Rowley | |
| 5,131,337 | A | 7/1992 | Wang | |
| 5,226,377 | A | 7/1993 | Kastre | |
| 5,520,127 | A | 5/1996 | JeanBlanc | |
| 5,560,308 | A | 10/1996 | Eto | |
| 5,690,040 | A | 11/1997 | Nakayama et al. | |
| 5,732,641 | A | 3/1998 | Kawasaki | |
| 5,762,014 | A | 6/1998 | JeanBlanc | |
| 5,927,221 | A | 7/1999 | Porter et al. | |
| 6,044,783 | A * | 4/2000 | Moniz | 112/475.06 |
| 6,244,202 | B1 * | 6/2001 | Tsuta | 112/260 |
| 6,725,795 | B2 * | 4/2004 | Gonzalez | 112/470.07 |

(Continued)

*Primary Examiner*—Ismael Izaguirre
(74) *Attorney, Agent, or Firm*—Quarles & Brady LLP

(57) ABSTRACT

A sewing machine that can be easily set up for minimizing selvedge includes a needle plate assembly and a reciprocating needle. The reciprocating needle is supported above the needle plate for joining at least two pieces of material together. A sew guide is spaced laterally from the reciprocating needle a predetermined distance corresponding to a selvedge length of selvedge extending from the joined material for guiding the pieces of material being joined beneath the needle. A spacer abutting the sew guide laterally spaces the sew guide at the predetermined distance corresponding to the selvedge length.

18 Claims, 5 Drawing Sheets

U.S. PATENT DOCUMENTS 6,792,883 B2 9/2004 Ashton
2002/0152939 A1 10/2002 Ashton
2003/0127031 A1 7/2003 Gonzalez

* cited by examiner

METHOD AND APPARATUS FOR MINIMIZING SEW SELVEDGE

CROSS REFERENCES TO RELATED APPLICATIONS

This application claims the priority benefit of U.S. Provisional Patent Application No. 60/633,716 filed on Dec. 6, 2004.

STATEMENT REGARDING FEDERALLY SPONSORED RESEARCH

Not Applicable.

BACKGROUND OF THE INVENTION

The present invention relates to sewing, in particular to a sewing machine, setting up the sewing machine for sewing an article, a sewn article, and a method for sewing two or more pieces to form the sewn article.

Multiple pieces of material are often sewn together to form a sewn article. For example, a covering for a leather seat in an automobile comprises two or more pieces of leather which are sewn together along edges of the individual leather pieces. The seam between the two pieces, must be strong to prevent the pieces from separating, and, in the example of a car seat covering, the seam should be decorative, or pleasing to the consumer.

A known article, shown in FIGS. 1 and 2, uses a join seam to join two pieces of material, such as leather, for car seat covering. The article is formed by positioning the two pieces of leather on top of each other, such that the finished surfaces of the pieces are facing each other. The two pieces of leather are joined by sewing the join seam spaced inwardly from an edge of the pieces to define a selvedge between the seam and the edge of each piece of leather. The article is then laid flat, such that the finished surfaces of the leather pieces face upwardly to form an outer surface of the car seat cover.

This particular method has been in use for many years. The material, such as leather, is expensive, and the selvedge is often large, such as 7–10 mm, to simplify sewing the article. Unfortunately, the selvedge is unseen in the finished product except for an unsightly bulge adjacent the seam, and in many article, serves no useful purpose. Therefore, the large selvedge constitutes wasted material that increases the cost of the article. In articles in which a smaller selvedge is required, the large selvedge is often cut down to the smaller selvedge length in a separate operation after the article is sewn. The material cut away from the selvedge is discarded as waste, and the cutting process requires additional labor which further increases the cost of the article.

Sewing machines can be specifically set up to form articles having a small selvedge by adjusting a sew guide to the desired selvedge length. The sew guide engages the material being sewn to guide the material past the needle. Adjusting a sew guide on a sewing machine to provide any particular selvedge length is time consuming. In particular, when adjusting the sew guide close to moving sewing machine components, such as a reciprocating needle, extra care and time must be taken to properly measure and secure the sew guide to ensure the sewing guide is properly positioned and to avoid damage to the sewing machine.

Moreover, moving the sew guide closer to the needle of the sewing machine forms a small gap between the sew guide and sewing machine components. The article being sewn tends to ride up in the small gap and jam the sewing machine compared to a sewing machine set up to form an article having a selvedge of greater than 7 mm. Therefore, articles requiring small selvedges are typically sewn without the use of a sew guide and the operator must visually maintain the edge of the article proper positioned relative to the needle. Accordingly, sewing machine operators find that sewing articles having a small selvedge, i.e. a selvedge less than 7 mm, is more difficult. Therefore, a need exists for a simple method and apparatus that minimizes selvedge

SUMMARY OF THE INVENTION

The present invention provides a method and apparatus for joining two pieces of material with minimal selvedge. The apparatus is a sewing machine including a needle plate and a reciprocating needle. The reciprocating needle is supported above the needle plate for joining at least two pieces of material together. A sew guide is spaced laterally from the reciprocating needle a predetermined distance corresponding to a selvedge length of selvedge extending from the joined material for guiding the pieces of material being joined beneath the needle. A spacer abutting the sew guide laterally spaces the sew guide at the predetermined distance corresponding to the selvedge length of the selvedge.

A general objective of the present invention is to provide a sewing machine that minimizes selvedge. This objective is accomplished by providing a sew guide that abuts a spacer to laterally space the sew guide at the predetermined distance corresponding to the desired selvedge length of the selvedge.

Another objective of the present invention is to provide a method for quickly setting up a sewing machine to form an article having selvedge with a predetermined selvedge length. This objective is accomplished by providing an adjustable sew guide and adjusting the sew guide to abut the spacer.

These and still other objects and advantages of the present invention will be apparent from the description which follows. In the detailed description below, preferred embodiments of the invention will be described in reference to the accompanying drawings. These embodiments do not represent the full scope of the invention. Rather the invention may be employed in other embodiments. Reference should therefore be made to the claims herein for interpreting the breadth of the invention.

DETAILED DESCRIPTION OF THE INVENTION

Figure 1:
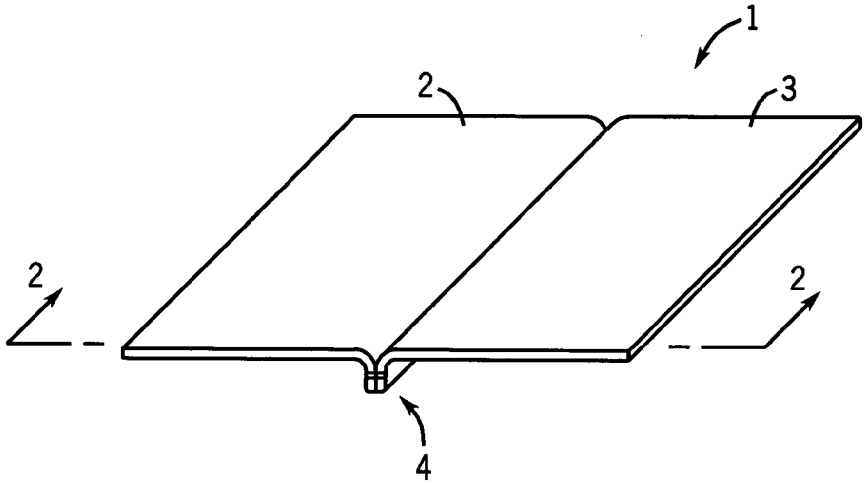
FIG. 1 PRIOR ART
FIG. 1 is a perspective view of prior art sewn article.
Figure 2:
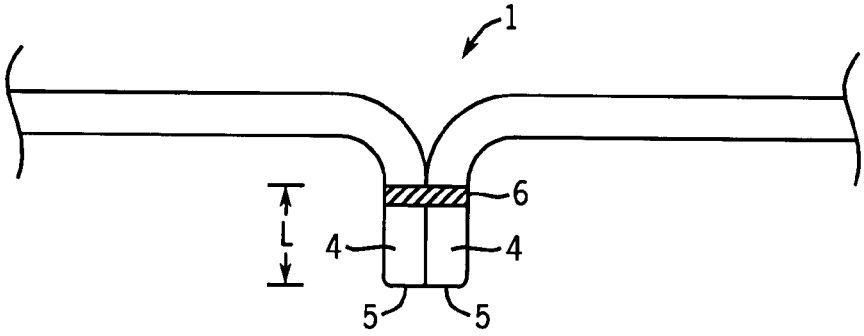
FIG. 2 PRIOR ART
FIG. 2 is a sectional view along line 2—2 of FIG. 1.

As shown in FIGS. 1 and 2, a sewn article 1 is formed from two pieces 2, 3 of planar, flexible material sewn together. A sew selvedge 4 extends inwardly a predetermined selvedge length L from an edge 5 of each piece 2, 3 to a join seam 6 extending substantially parallel to the edges 5. Preferably, the join seam 6 is sewn using a single needle sewing machine 10 that is easily set up to minimize the sew selvedge 4, such as described below.

Figure 3:
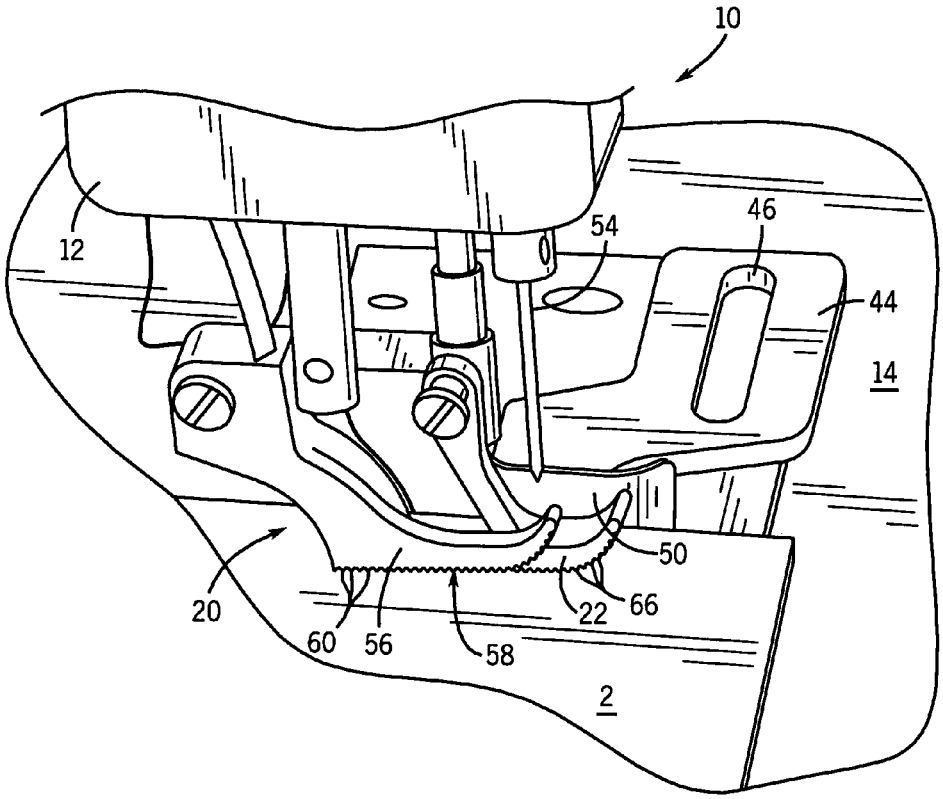
FIG. 3 is a side perspective view of a sewing machine incorporating the present invention.
Figure 4:
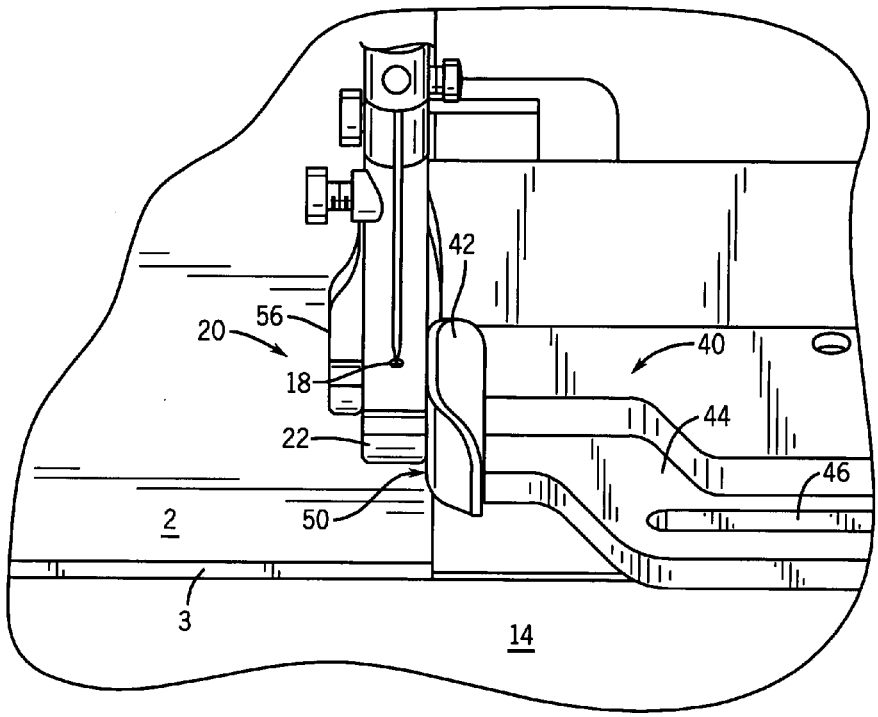
FIG. 4 is a front perspective view of the sewing machine of FIG. 3.
Figure 5:
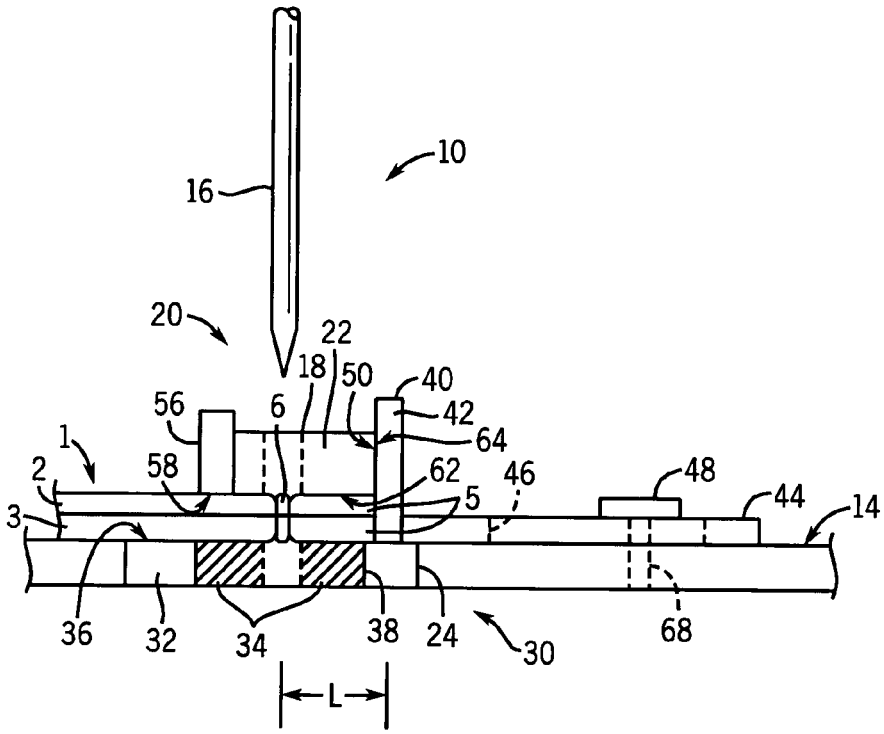
FIG. 5 is a schematic elevational front view of the sewing machine of FIG. 3.

Referring to FIGS. 3–5, the preferred embodiment of the present invention is a commercially available single needle sewing machine 10, such as a 767 Dürkopp Adler available from Dürkopp Adler America, Inc., Norcross, Ga., or sewing machines from Consew, New York, N.Y., that has been modified to incorporate the present invention, such as described below. The sewing machine 10 includes an upper housing 12 supported above a bed 14. The upper housing 12 supports a reciprocating sewing needle 16 which passes through an aperture 18 formed in a presser foot assembly 20 extending downwardly from the upper housing 12. The reciprocating needle 16 pierces both pieces 2, 3 of material and is reciprocatively received in an opening 24 formed in a needle plate assembly 30 mounted in the bed 14. The needle 16 passes thread through the pieces 2, 3 of material to form the join seam 6 joining the pieces 2, 3 together and form the selvedges 4 extending from the join seam 6 of the article 1, as is known in the art. Advantageously, the edge 5 of each piece 2, 3 of material abuts a sew guide 40 which accurately guides the material pieces 2, 3 beneath the needle 16.

The sew guide 40 is fixed to the bed 14 and laterally spaced from the needle 16 a distance equal to the selvedge length L, and engages the edge 5 of the pieces 2, 3 of material to guide the pieces 2, 3 as they pass underneath the needle 16. The sew guide 40 can be adjacent to, or extend over, the needle plate assembly 30 depending upon the width of the needle plate assembly 30 and desired selvedge length L. The sew guide 40 includes a wear plate 42 defining a vertically oriented wear surface 50 that engages 5 the edge of the pieces 2, 3. The lateral distance between the wear surface 50 and needle 16 defines the selvedge length L. The wear plate 42 is adjustably fixed to the bed 14 by a mounting plate 44 fixed to the wear plate 42, such as by welding.

The mounting plate 44 extends laterally away from the needle 16, and is adjustably mounted to the bed 14 to fix the wear surface 50 relative to the needle 16. Preferably, the mounting plate 44 includes a laterally extending slot 46 for receiving a mounting screw 48 that threadably engages a mounting hole 68 formed in the bed 14 to detachably and adjustably mount the mounting plate 44, and thus the wear plate 42, to the bed 14. The mounting screw 48 is tightened down against the mounting plate 44 to fix the wear plate 42, and thus the wear surface 50, relative to the needle 16. Advantageously, the mounting screw 48 is loosened to allow the mounting plate 44 to move relative to the bed 14 which moves the wear surface 50 laterally relative to the needle 16 for accommodating different selvedge lengths L, and thus form different length selvedges 4. Although providing an adjustable sew guide 40 is preferred, if the sewing machine 10 is only intended to join pieces 2, 3 with selvedges 4 having a specific selvedge length L, the sew guide 40 can be fixed permanently relative to the needle 16 without departing from the scope of the invention. Moreover, although adjustably mounting the sew guide 40 using a mounting screw 48 extending through the slot 46 formed in the mounting plate 44 and threadably engaging the mounting hole 68 formed in the bed 14 is disclosed, other methods for fixing the wear surface 50 relative to the needle 16 can be used, such as clamping the sew guide 40 to the bed 14 using clamps, clips, and other mechanical fasteners, without departing from the scope of the invention.

The needle plate assembly 30 is mounted in the opening 24 formed in the bed 14, and supports the article 1 beneath the needle 16. The needle plate assembly 30 includes a needle plate 32 and a feed dog 34 which advances the article 1 beneath the needle 16. The needle plate 32 includes a horizontal surface 36 having an opening 38 through which the feed dog 34 extends. The feed dog 34 engages the article 1 positioned over the horizontal surface 36 and opening 38 to advance the article 1 past the needle 16. The article 1 is advanced along the direction of travel by the feed dog 34 each time the needle 16 is withdrawn from the article 1 to provide a continuous join seam 6 in the pieces 2, 3 of material.

The feed dog 34 extends upwardly through the opening 38 in the needle plate 32, and engages the pieces 2, 3. The feed dog 34 pinches the article 1 against the presser foot assembly 20, and pulls the article 1 past the needle 16 in the direction of article travel. Preferably, the feed dog 34 includes rows of teeth or cleats (not shown) that engage the lower piece 3 to pull the article 1 past the needle 16.

The presser foot assembly 20 is a "walking foot" feed mechanism that extends downwardly from the upper housing 12, and cooperates with the feed dog 34 to advance the article 1 past the needle 16. As is known in the art, the presser foot assembly 20 of a "walking foot" feed mechanism includes a reciprocating outer foot shaft 52 and needle guide shaft 54 extend downwardly from the upper housing 12 and independently support an outer foot 56 and the needle guide 22 above the needle plate assembly 30. Advantageously, the width of the needle guide 22 is selected to quickly set up the sewing machine 10 for sewing the article 1 having selvedges 4 with a desired selvedge length L.

The outer foot 56 is spaced laterally from the sew guide 40 in a direction laterally away from the needle 16, and is detachably mounted to the outer foot shaft 52 which reciprocatively moves the outer foot 56 between a rearward position and a forward position. Preferably, the outer foot 56 includes a bottom surface 58 having rows of teeth 60 that engages the article 1, and secures the article 1 against the needle plate assembly 30 as the outer foot 56 moves from the rearward position in the direction of article travel to the forward position to pull the article 1 in the direction of article travel. Upon reaching the forward position, the outer foot 56 is raised vertically by the outer foot shaft 52 to disengage the outer foot 56 from the article 1 and move the outer foot 56 rearwardly back toward the rearward position at which point the outer foot 56 is lowered to engage the article 1.

The needle guide 22 is detachably mounted to the needle guide shaft 54, and is interposed between the outer foot 56 and the sew guide 40. A wear surface 64 facing the sew guide 40 slidably engages the sew guide 40, as the needle guide 22 moves between the forward position and the rearward position by the needle guide shaft 54. The lateral distance between the needle 16 and the needle guide wear surface 64, and thus the sew guide wear surface 50, defines the selvedge length L.

The aperture 18 formed through the needle guide 22 reciprocatively receives the needle 16, and guides the needle 16 through the article 1 and into the needle plate opening 38. Preferably, the needle guide 22 fills the space between the outer foot 56 and sew guide 40 requiring the aperture 18 for guiding the needle 16 to prevent material from getting caught between the needle guide 22 and the outer foot 56 and sew guide 40. However, the needle guide 22 can extend from the needle 16 laterally toward the sew guide 40 eliminating the need for an aperture 18 through the needle guide 22 without departing from the scope of the invention. Of course, the aperture 18 can be a through hole having any shaped cross section, a slot open to an edge of the needle guide 22, and the like, without departing from the scope of the invention.

The needle guide 22 includes a bottom surface 62 having rows of teeth 66 that engage the article 1, and secures the article 1 against the needle plate assembly 30 as the needle guide 22 moves from a rearward position in the direction of article travel to a forward position to pull the article 1 in the direction of article travel beneath the needle 16. The needle guide 22 engages the article 1 alternately with the outer foot 56 to continuously urge the article 1 in the direction of article travel. Although a "walking foot" feed mechanism, such as described above, is preferred, any type of feed mechanism known in the art, such as a differential feed, needle feed, puller feed, wheel feed, and the like, can be used without departing from the scope of the invention.

In the embodiment disclosed herein, the sewing machine 10 is set up to create the article 1 having the desired selvedge length L by mounting the needle guide 22, having the wear surface 64 facing the sew guide 40 and spaced laterally from the needle 16 toward the sew guide 40 a distance corresponding to the predetermined selvedge length L, to the needle guide shaft. The sew guide 40 is then moved laterally toward the needle guide 22 until the sew guide wear surface 50 abuts the needle guide wear surface 64. Once the sew guide 40 is abutting the needle guide 22, the sew guide 40 is fixed relative to the needle 16 by tightening the mounting screw 48 against the mounting plate 44 to fix the sew guide 40 to the bed 14.

Advantageously, by abutting the sew guide 40 with the needle guide 22, the sew guide 40 is positively stopped at the desired lateral distance from the needle 16 defining the desired selvedge length L which simplifies setting up the sewing machine 10 for the particular selvedge length L prior to use. In addition, positioning the sew guide 40 in abutting engagement with the needle guide 22 eliminates a gap between the sew guide 40 and needle guide 22 in which the article 1 can ride up and jam the sewing machine 10. Moreover, if the sew guide 40 is pulled away from the desired selvedge length setting, such as by snagging the article 1 or an inadvertent bump, an operator can easily reset the sew guide 40 to the desired selvedge length L by readjusting the sew guide 40, such that the sew guide wear surface 50 abuts the needle guide wear surface 64, without remeasuring the distance between the needle 16 and sew guide 40 or calling a technician to reset up the sewing machine 10.

The desired selvedge length L is dependent upon the thickness of the material forming the article 1. Advantageously, the sewing machine 10 can be provided with a plurality of needle guides 22 in a kit, each needle guide 22 corresponding to a different desired selvedge length L, such as a 3 mm, 5 mm, and 7 mm selvedge length. The needle guide 22 can be quickly interchanged to set up the sewing machine 10 for sewing an article 1 having a different desired selvedge length L. Although laterally spacing the sew guide 40 relative to the needle 16 by abutting the sew guide 40 with the needle guide 22 is preferred, any spacer, such as a block fixed to the outer foot 56 and extending over the article 1 past the needle 16 toward the sew guide 40, that positively engages the sew guide 40 at the predetermined distance corresponding to the desired selvedge length L can be used without departing from the scope of the invention. Accordingly, if the sewing machine 10 does not require a needle guide 22, any spacer that positively engages the sew guide 40 at the predetermined distance corresponding to the desired selvedge length L can be used without departing from the scope of the invention.

The sewing machine 10 described above creates the article 1 having the join seam 6 which can be used to create a sewn article have a French seam formed using a double needle sewing machine, such as described in U.S. Pat. No. 6,792,883, which is assigned to the assignee of the present invention, and fully incorporated herein by reference.

Figure 6:
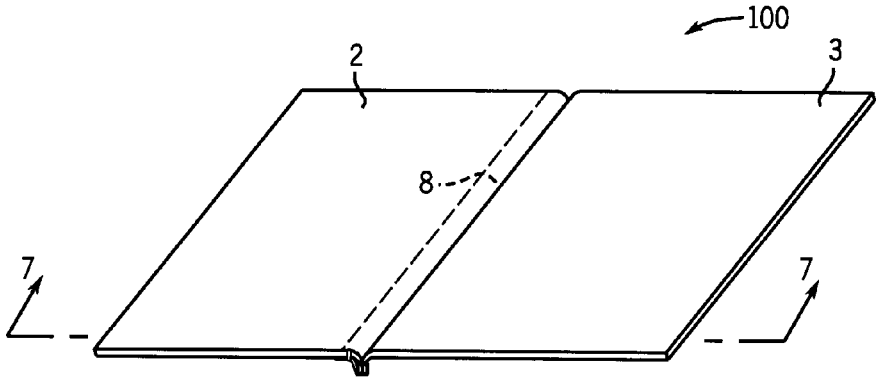
FIG. 6 is a perspective view of a sewn article produced by the sewing machine of FIG. 3.
Figure 7:
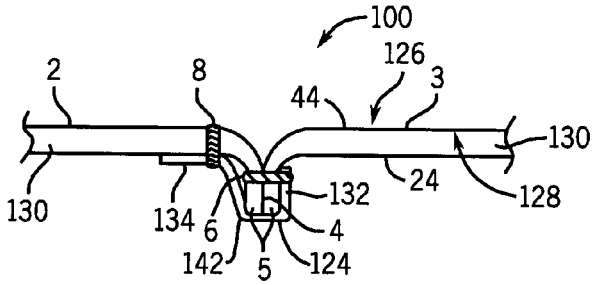
FIG. 7 is a sectional view along line 7—7 of FIG. 6.

As shown in FIGS. 6 and 7, the join seam 6 created by the single needle sewing machine 10 described above can be reinforced using an elongated tape 124 to create a sewn article 100 having a reinforced seam without requiring the use of a double needle sewing machine. The reinforced sewn article 100 is formed from the two pieces 2, 3 of planar, flexible material sewn together. The tape 124 is sewn to, and over, the selvedges 4 to strengthen the join seam 6 between the two pieces 2, 3.

Each piece 2, 3 of material has a finished surface 126 and an unfinished surface 128. The unfinished surface 128, can include a backing material 130, such as foam, fixed to the pieces 2, 3 using methods known in the art, such as adhesives, and the like. The pieces 2, 3 can be any sewable material known in the art, such as synthetic or natural leather, fabric, and the like, with or without backing material. Although, pieces 2, 3 having a finished and unfinished surface are disclosed, the pieces 2, 3 can have two finished surface or no finished surfaces without departing from the scope of the intention. Moreover, even though joining two pieces is disclosed, two or more pieces of material can be joined without departing from the scope of the invention.

The elongated tape 124 having longitudinal edges 132, 134 joined by a web 142 extends along the join seam 6. One of the longitudinal edges 132 is fixed to the selvedge 4 of one piece 3 of the material, and the other longitudinal edge 134 is fixed to the other piece 2 of material, such that the web 142 covers the ends 5 of the pieces 2, 3 of material to increase the tensile strength and integrity of the join seam 6 between the two pieces 2, 3. The tape 124 can be any type of material known in the art which can be joined to the pieces 2, 3 of material using methods known in the art, such as sewing, adhesives, rivets, and the like. Preferably, the tape 124 is formed from nylon, however, any tape material known in the art which reinforces the join seam 6 between the pieces 2, 3 can be used, without departing from the scope of the invention.

The tape 124 can be fixed to the selvedge 4 of the one piece 3 of material and to the other piece 2 of material using methods known in the art, such as sewing, adhesives, welding, and the like. Of course, the tape 124 can be fixed to the selvedge 4 of the one piece 3 of material by the join seam 6, as shown in FIG. 7, when the join seam 6 is made to minimize labor and thread. Advantageously, this article 100 has a reinforced join seam 6 with only one additional visible seam 8 if the other longitudinal edge 134 is sewn to the other piece 2 of material to provide a decorative stitch, and no additional viewable seams if the other longitudinal edge 134 is fixed to the other piece 2 of material using other methods, such as adhesives or welding.

The sewn article 100 can be fabricated by positioning the one piece 3 of material on a flat surface with the finished surface 126 facing upwardly, and positioning the other piece 2 of material over the one piece 3, such that the finished surfaces 126 of both pieces 2, 3 are facing each other. The edge 5 of both pieces 2, 3 of material that are to be sewn together are aligned, and positioned to abut the sew guide 40 as the article 100 passes beneath the needle 16 the single needle sewing machine 10. The join seam 6 is then sewn by the needle 16 along a line parallel to the edges 5 and spaced inwardly a distance equal to the desired selvedge length L using the single needle sewing machine 10. Preferably, the sew guide 40 is set to abut the needle guide 22 defining the selvedge length L, such as 3–7 mm, appropriate to the material thickness to avoid wasting material.

Once the join seam 6 is sewn, if the same sewing machine 10 is used, the operator can quickly and easily slide the adjustable sew guide 40 away from the needle guide 22 to sew the tape 124 to the selvedge 4 of the one piece 3 of material, as described below. The tape 124 is fixed to the article 100 by positioning the tape 124 over the selvedges 4, such that the longitudinal edge 132, of the tape 124 overlaps a portion of the selvedge 4 of the one pieces 3 of material. Of course, the tape 124 can be temporarily fixed to the pieces 2, 3 using adhesives, adhesive tape, and the like, to avoid movement of the tape 124 when permanently fixing the tape 124 to the pieces 2, 3. The tape 124 is then folded over the material edges 5, and the other longitudinal edge 134 is fixed to the other piece 2 of material, such as by sewing, adhesives, welding, and the like. If the same sewing machine 10 is used to fix the tape 124 to the article 100, the operator can adjust the sew guide 40 back into an abutting relation with the needle guide 22 to sew a join seam 6 having a selvedge 4 with the desired selvedge length L in the next article 100. Of course, in high volume operations, a second sewing machine (not shown) can be used that is set up to sew the tape 124 to the article 100 without departing from the scope of the invention.

While there has been shown and described what are at present considered the preferred embodiments of the invention, it will be obvious to those skilled in the art that various changes and modifications can be made therein without departing from the scope of the invention defined by the appended claims. For example, the sew guide wear plate extending into a slot formed in the bed can be fixed to the needle guide wear surface the desired lateral distance corresponding to the desired selvedge length, such as by welding, mechanical fasteners, linkages, and the like, without departing from the scope of the invention.

I claim:

1. A sewing machine for joining two pieces of material, said sewing machine comprising:

a bed;

a needle plate assembly mounted to said bed;

a reciprocating needle supported above said needle plate assembly for joining at least two pieces of material together;

a sew guide fixed to said bed and spaced laterally from said reciprocating needle a predetermined distance corresponding to a predetermined selvedge length of selvedge extending from at least one of the at least two pieces of material for guiding the pieces of material being joined beneath said needle;

a spacer abutting said sew guide and laterally spacing said sew guide at said predetermined distance corresponding to the predetermined selvedge length, said spacer being a needle guide having an opening which guides said needle; and an outer foot laterally spaced from said sew guide for securing the material against said needle plate assembly as said needle is received through said opening.

2. The sewing machine as in claim 1, in which said spacer moves relative to said sew guide prior to being fixed to said bed.

3. The sewing machine as in claim 1, in which said spacer has a wear surface laterally spaced from said needle at said predetermined distance corresponding to the predetermined selvedge length, and said wear surface abuts said sew guide to laterally space said sew guide at said predetermined distance.

4. The sewing machine as in claim 1, in which said predetermined distance is up to about 7 mm.

5. The sewing machine as in claim 1, in which said predetermined distance is less than about 5 mm.

6. The sewing machine as in claim 1, in which said needle plate assembly includes a feed dog disposed beneath said needle, and said spacer secures the material against said feed dog.

7. The sewing machine as in claim 6, in which said spacer extends laterally from said needle a distance at least equal to said predetermined distance.

8. A method of setting up a sewing machine to form a selvedge having a predetermined selvedge length in an article sewn on the sewing machine, the sewing machine having a reciprocating needle supported above a needle plate assembly mounted to a bed, a laterally adjustable sew guide spaced laterally from the reciprocating needle for guiding the article beneath the needle, and an outer foot laterally spaced from said sew guide for securing the material against said needle plate assembly, said method comprising:

fixing said sew guide to the bed; and providing a spacer abutting said sew guide and laterally spacing the needle from the sew guide a distance corresponding to the predetermined selvedge length, said spacer being a needle guide having an opening which guides said needle.

9. The method as in claim 8, in which said sew guide is fixed relative to said needle by adjustably fixing said sew guide to a bed forming part of the sewing machine.

10. The method as in claim 8, in which said spacer is selected from a group of spacers which space said sew guide from said needle different distances.

11. A method of joining two pieces of material, said method comprising:

positioning a first piece of material over a second piece of material;

aligning an edge of said first piece of material with an edge of said second piece of material;

engaging said edges with a sew guide laterally spaced from a reciprocating needle by a spacer abutting said sew guide and laterally spacing said sew guide a distance equal to a desired selvedge length of a selvedge formed between a seam created by said reciprocating needle and said material edges, said sew guide being fixed to a bed disposed beneath said needle and said spacer being a needle guide having an opening which guides said needle;

securing said first and second pieces of material against said needle plate assembly using an outer foot laterally spaced from said sew guide; and sewing said first and second pieces of material together using said needle to form selvedges extending from said seam to said edges.

12. A method of joining two pieces of material, said method comprising:

positioning a first piece of material over a second piece of material;

aligning an edge of said first piece of material with an edge of said second piece of material;

engaging said edges with a sew guide laterally spaced from a reciprocating needle by a spacer laterally spacing said sew guide a distance equal to a desired selvedge length of a selvedge formed between a seam created by said reciprocating needle and said material edges;

sewing said first and second pieces of material together using said needle to form selvedges extending from said seam to said edges, including fixing a longitudinal edge of an elongated third piece of material to at least one of said selvedges, covering said edges of said first and second pieces of material with said third piece of material, and fixing an opposing longitudinal edge of said third piece of material to one of said first and second pieces of material.

13. The method as in claim 12, in which at least one of said longitudinal edges of said third piece of material is fixed by sewing.

14. An article comprising:

a first piece of material having a selvedge extending from a seam to an edge of the material;

a second piece of material having a selvedge extending from said seam to an edge of said second material, said second piece of material being fixed to said first piece of material along said seam;

a third piece of material covering said edges, and having a first longitudinal edge fixed to at least one of said selvedges on one side of said seam and a second longitudinal edge fixed to one of said first and second pieces on an opposite side of said seam.

15. The article as in claim 14, in which at least one of said longitudinal edges is fixed by sewing.

16. The article as in claim 14, in which said first longitudinal edge is fixed to said at least one of said selvedges along said seam.

17. A kit for use with a sewing machine suitable for joining two pieces of material, said sewing machine including a needle plate assembly, a reciprocating needle supported above the needle plate mounted to a bed for joining at least two pieces of material together, a sew guide spaced laterally from the reciprocating needle a predetermined distance corresponding to a predetermined selvedge length of selvedge extending from at least one of the at least two pieces of material for guiding the pieces of material being joined beneath said needle, and an outer foot laterally spaced from said sew guide for securing the material against said needle plate assembly, said kit comprising:

at least two spacers defining different predetermined distances corresponding to different predetermined selvedge lengths, wherein, in use, one of said spacers is abutting said sew guide fixed to said bed and laterally spaces said sew guide at said predetermined distance defined by said one of said spacers, said spacers being needle guides having an opening which guides said needle.

18. The kit as in claim 17, in which one of said spacers defines a predetermined distance of no more than about 5 mm.

* * * * *